US006403887B1

(12) United States Patent
Kebabjian et al.

(10) Patent No.: US 6,403,887 B1
(45) Date of Patent: Jun. 11, 2002

(54) HIGH SPEED DATA TRANSMISSION CABLE AND METHOD OF FORMING SAME

(75) Inventors: Matthew T. Kebabjian, Jacksonville; Jerry J. Kulaga, St. Augustine, both of FL (US)

(73) Assignee: Tensolite Company, St. Augustine, FL (US)

( * ) Notice: Subject to any disclaimer, the term of this patent is extended or adjusted under 35 U.S.C. 154(b) by 0 days.

(21) Appl. No.: 09/429,414

(22) Filed: Oct. 28, 1999

Related U.S. Application Data

(63) Continuation-in-part of application No. 08/991,730, filed on Dec. 16, 1997, now Pat. No. 6,010,788.

(51) Int. Cl.[7] ..... H01B 7/00

(52) U.S. Cl. ..... 174/110 R; 174/113 R; 174/36

(58) Field of Search ..... 174/36, 102 R, 174/102 SP, 110, 113 R, 117 F, 117 FF; 428/381

(56) References Cited

U.S. PATENT DOCUMENTS

| | | | | |
|---|---|---|---|---|
| 220,944 A | | 10/1879 | Rogers et al. | |
| 290,122 A | | 12/1883 | Shaw | |
| 2,454,625 A | | 11/1948 | Bondon | |
| 4,096,346 A | | 6/1978 | Stine et al. | 174/36 |
| 4,368,214 A | * | 1/1983 | Gillette | 156/51 |
| 4,719,319 A | | 1/1988 | Tighe, Jr. | 174/103 |
| 4,965,412 A | | 10/1990 | Lai et al. | 174/107 |
| 5,015,800 A | * | 5/1991 | Vaupotic et al. | 174/34 |
| 5,142,100 A | * | 8/1992 | Vaupotic | 174/24 |
| 5,216,202 A | | 6/1993 | Yoshida et al. | 174/36 |
| 5,329,064 A | | 7/1994 | Tash et al. | 174/36 |
| 5,574,250 A | | 11/1996 | Hardie et al. | 174/36 |
| 6,005,193 A | | 12/1999 | Markel | 174/117 FF |

* cited by examiner

*Primary Examiner*—Dean A. Reichard
*Assistant Examiner*—William H. Mayo, III
(74) *Attorney, Agent, or Firm*—Wood, Herron & Evans LLP

(57) ABSTRACT

A high speed data transmission cable having a pair of primary cables positioned adjacent to each other along their lengths, with each primary cable including a pair of generally parallel conductors which are coupled together by an insulation structure. The insulation structure has a cross-section including shaped end portions wherein each end portion is defined by a reference point. The conductors are positioned proximate the reference points of the circular end portions. The shaped end portions are coupled together by a center portion to form the insulation structure having dimensions reflective of the dimensions of the end portions. A shield layer surrounds each primary cable along its length to isolate the primary cables from each other. The primary cables and corresponding shield layers are twisted together around a center axis and form a double helical structure.

27 Claims, 3 Drawing Sheets

HIGH SPEED DATA TRANSMISSION CABLE AND METHOD OF FORMING SAME

RELATED APPLICATIONS

The present invention is a continuation-in-part of U.S. patent application, Ser. No. 08/991,730, filed Dec. 16, 1997, now U.S. Pat. No. 6,010,788, issued Jan. 4, 2000, which is commonly owned with the present application, and which is incorporated herein by reference in its entirety.

FIELD OF THE INVENTION

This invention relates generally to data transmission cables and more specifically to a high speed data transmission cable which has low signal skew and attenuation, is mechanically durable and is able to deliver more consistent data signals at high data rates.

BACKGROUND OF THE INVENTION

There is currently a demand for high speed data transmission cables which are capable of high-fidelity signal transmission at minimal signal attenuation. The ever-increasing use of high speed computer equipment and telecommunications equipment has increased such demand.

One existing cable product capable of high data rate transmission is fiber-optic cable which has good bandwidth performance over long distances. Furthermore, fiber-optic cables provide very low attenuation and little interference or noise with the transmitted signal. However, despite their desirable signal transmission qualities, fiber-optic cables are still very expensive. Furthermore, when transmission of signals over shorter distances is required, fiber-optic cables become even less desirable from an economic standpoint. For high speed data transmission over relatively short distances, such as up to 50 meters, copper based, differential signal transmission cables are the predominant choice in the industry.

Differential signal transmission involves the use of a cable having a pair of conductors wherein the information or data which is transmitted is represented by a difference in voltage between each of the conductors of the pair. The data is represented in transmission by polarity reversals on the conductor pair, and the receiver or other equipment coupled to the receiving end of the cable determines the relative voltage difference between the conductors. The voltage difference is analyzed to determine its logical value, such as a 0 or 1. Differential pairs may be shielded or unshielded. Shielded differential pairs generally perform better than unshielded pairs because the internal and external environments of the conductors are isolated. Improved attenuation performance also usually results with shielded cables.

Differential signal transmission cables have a variety of desirable electrical characteristics, including immunity to electrical noise or other electrical interferences. Since the differential signals transmitted are 180° out of phase to provide a balanced-signal in the cable, and are considered to be complementary to one another, any noise will affect both of the conductors equally. Therefore, the differences in the signals between the conductor pairs due to external electrical noise and interference are generally negated, particularly for shielded pairs. It may also be true for unshielded differential pairs as well by varying the twisting of the pairs, for example. Differential signal transmission cables are also immune to cross-talk, that is, interference between the individual cables due to the signals on other cables which are bundled together into a multi-cable structure. Again, shielded differential pairs will generally outperform unshielded pairs with respect to cross-talk. Multiple differential signal cables in a larger overall cable structure are referred to as primary cables.

Since differential signal transmission relies upon parallel transmission of the data signal and comparison of the differences in those signals at the receiving end of the cable, it is desired that the corresponding signals of each pair arrive at the receiving end at the same time. Because of insulative property differences experienced by each conductor of a cable pair, such as differences due to dielectric inconsistencies in the insulation and/or simply the physical characteristics of the cable, differential signal transmission cables are subject to signal skew. Signal skew is defined as the time delay of the arrival of one of the corresponding or complimentary signals at the receiving end of a conductor with respect to the other signal on the other conductor of the pair. In simpler terms, one complimentary signal arrives at the receiving end of the cable faster than the other signal. This signal skew condition is exaggerated as cable length increases. Generally, a signal skew budget is designed into data transmission systems, and the cables which link the systems are allowed only a portion of the budget. Therefore, signal skew is an important parameter which must be considered when using a differential signal transmission cable.

As will be appreciated, it is desirable to keep signal skew in a cable to a minimum to prevent errors in communication. Furthermore, low signal skew is necessary for proper cancellation of noise, because if the two opposing signals do not arrive at the receiving end at the same time, a certain amount of the noise in the cable will not be cancelled. A lower signal skew will also minimize jitter, which is the amount of real time it takes for the signal rising and falling edges to cross, which allows a differential signal transmission cable to be utilized at greater lengths or distances. It is therefore desirable to utilize a data transmission cable having a relatively low signal skew.

Another desirable characteristic in differential signal data transmission cables is low attenuation. Attenuation will generally be affected by the 20 physical structure of the cable defining its impedance and including the shield type and design, the dielectric material used as insulation, the position of the conductors, and the electrical interaction between the conductors of the cable. If the cable is poorly constructed, the dielectric material properties, conductor-to-dielectric geometry, and hence impedance characteristics of the cable, may vary along its length, thus increasing its signal attenuation or loss characteristics when the cable is subjected to use. Accordingly, it is desirable to utilize a cable which has low attenuation characteristics at the desired operating frequency, so that cable length can be maximized, and also to utilize a cable which maintains constant, low attenuation characteristics during use.

To that end, it is further desirable to maintain the conductors in consistent positions within the cable insulation and in consistent positions with respect to one another. It is also desirable to maintain consistent dielectric properties of the cable insulation along its length to reduce impedance variations and hence reduce attenuation and signal skew. At the same time, high speed data transmission cables should still be flexible and able to withstand the mechanical and physical abuses associated with usage.

For example, the distance between the conductors, as well as the distance from the center of each conductor to the outer surface of the dielectric, should be consistent along the length of the cable.

Data transmission cables have been designed to address various of the concerns discussed above and to reduce signal skew while maintaining a durable and cost-effective cable. For example, the cable disclosed in U.S. Ser. No. 08/991,730, filed Dec. 16, 1997, which is commonly owned with the present application, discloses a cable with low signal skew and a robust design. U.S. Ser. No. 08/991,730 is incorporated herein by reference in its entirety. Such a cable requires particular attention to the placement of the cable elements during its formation, and specifically requires attention to the concentricity of each wire and tension of the cable and the proper placement of the shield for reducing skew. While the cable has produced desirably low skew figures, it is still an objective to improve upon its design.

Specifically, it is noted that varying electric charge on the cable and between the conductors will degrade the skew performance of the cable.

The rising and falling edges of the differential signal are affected by such charge variation. Particularly, the edge degradation of the signal's rising and falling edges may vary between the conductors (often referred to as slew) due to charge variation. The slew characteristics of a cable directly affect the skew characteristics of that cable.

Accordingly, it is an objective of the present invention to provide a high-speed data transmission cable which produces relatively low signal skew, and minimizes signal attenuation within a high-speed data transmission cable at the particular driven frequencies of the cable.

It is another objective of the present invention to provide a flexible and durable high-speed data transmission cable which maintains a more consistent dielectric constant along its length.

It is another objective to have a cable with such properties as discussed herein which may be manufactured in a cost effective manor while maintaining consistent and desirable properties, such as low signal skew.

It is still a further objective of the present invention to provide a high-speed data transmission cable which can be used at greater lengths than the present high speed data cables, or at higher frequencies than the present high-speed data cables.

It is still a further objective of the invention to maintain the integrity of the data signal transmitted through the cable and to thus minimize the delay, distortion and attenuation of that signal.

SUMMARY OF THE INVENTION

The above objectives and other objectives are met by a high speed data transmission cable comprising a pair of primary cables utilizing a combination of unique insulation structures and shields to provide a cable which has improved skew characteristics.

Specifically, the cable comprises a pair of primary cables positioned adjacent to each other along their lengths. Each primary cable includes a pair of generally parallel conductors which are coupled together by an insulation structure. A shield layer surrounds each primary cable along its length to isolate the primary cables from each other. The primary cables are then twisted together, along with their corresponding shield layers, to form a double helical structure around a common longitudinal center axis. The unique combination of the construction of the primary cables, along with their shielding and twisting to form the finished cable, provides improved skew properties with respect to the prior art.

In one embodiment of the invention, the insulation structure has a cross-section which includes circular end portions wherein each of the end portions is defined by a center point and a radius dimension. The conductors are positioned proximate the center points of the circular end portions. The circular end portions are coupled together by a center portion which has a cross-sectional height dimension reflective of the radius dimension of the end portions, such that the insulation structure cross-section has generally flat top and bottom surfaces. The flat top and bottom surfaces allow the primary cables to be positioned adjacent to each other and generally flat against each other for being twisted into a double helical structure around a common longitudinal axis in accordance with the principles of the present invention.

The conductors are spaced from each other a distance of approximately two times the radius dimension of the circular end portions and the cross-sectional height dimension in the center portion is approximately two times the radius dimension of the circular end portions. The latitudinal length dimension of the insulation structure cross-section is approximately four times the radius dimension of the circular portions. In that way, the cross-sectional dimensions of the primary cable are reflective of the defined radius in the circular end portions.

In one embodiment of the invention, the circular end portions and the center portion of the insulation structure are integrally formed. In another embodiment of the invention, two conductors which are individually insulated and having a circular cross section, are coupled together by a center portion which is formed therebetween and fused to the individual insulated conductors to form the inventive insulation structure.

In another embodiment of the invention, the inventive insulative structure is formed utilizing a primary cable having a generally figure eight cross-section, wherein the center portion is formed with the figure eight cross-section and is fused thereto to form the insulation structure.

In still another embodiment of the invention, the circular end portions may be integrally formed to include a section of the center portion. The sections of the center portion are then fused together to form the complete insulation structure of the cable.

Another embodiment of the invention utilizes an insulation structure having another unique shape. The insulation structure includes a cross-section having parabolic end portions wherein each end portion is defined by a focus point defining the parabola. The conductors are positioned proximate the focus points of the parabolic end portions. A center portion is positioned between the parabolic end portions and couples the end portions together, such that the primary cable has flat top and bottom surfaces. The focus point is positioned a defined distance from a bottom point of the parabolic end portion, and that defined distance is used to determine other dimensions of the cable in accordance with the principles of the invention. For example, in one embodiment of the invention, the conductors are spaced from each other a distance which is approximately two-and-one-half times the defined distance of the end portions, whereas the cross-sectional height of the center portion is approximately three times the defined distance. The latitudinal length of the cable cross section is approximately four-and-one-half times the defined distance of the end portions.

Similar to the embodiment of the invention discussed above, the insulation structure may be integrally formed around the conductors, or it might be formed in multiple pieces which are fused together to form the overall insulation structure.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
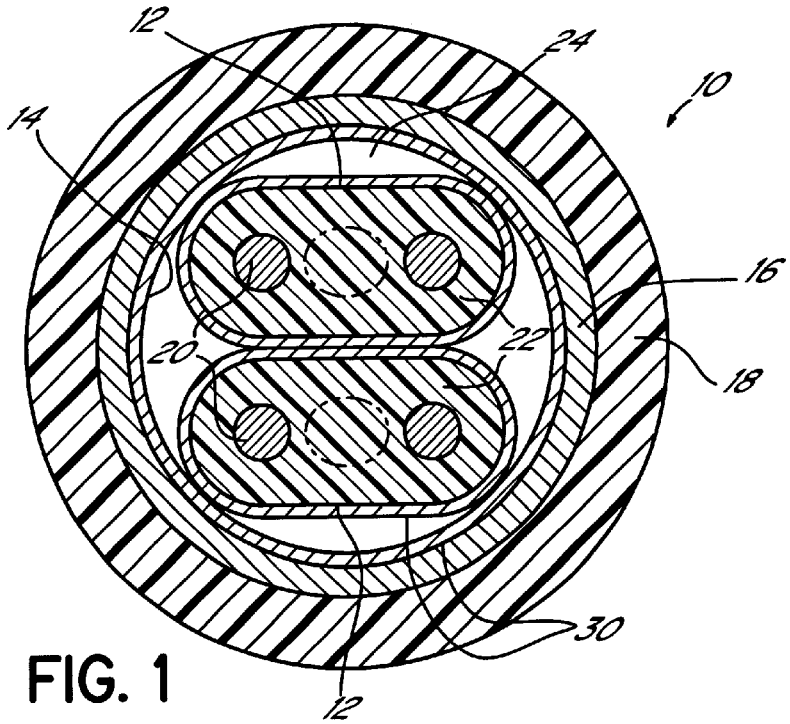
FIG. 1 is a cross-sectional view of an embodiment of the inventive cable.

FIG. 1 illustrates a cross-sectional view of one embodiment of a high-speed data transmission cable in accordance with the principles of the present invention. Cable or cable structure 10 comprises a pair of primary cables 12 which are positioned adjacent to each other along their lengths. The primary cables 12, or primaries, are oriented flat against each other and are surrounded by a first overall shield 14, a second overall shield 16, and a plastic insulative jacket 18. Each primary cable 12 comprises a pair of generally parallel conductors 20 surrounded by an insulation layer 22. The primaries are twisted in forming the invention shown in FIG. 2.

Figure 2:
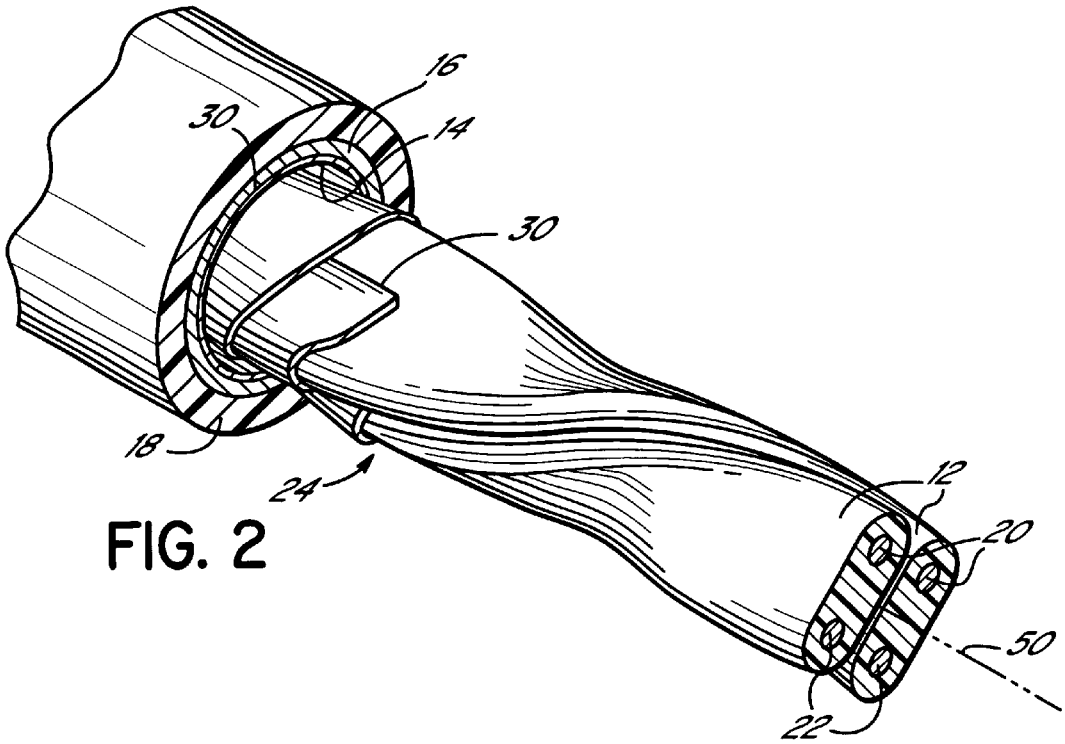
FIG. 2 is a perspective view of the primary cables of an embodiment of the inventive cable, shown wrapped into the overall cable about a center longitudinal axis.

In accordance with one aspect of the present invention, the cross-sectional shape of the primary cables 12 may be any one of a number of unique inventive shapes in accordance with the principles of the present invention. As discussed further hereinbelow, the unique cross-sectional shapes of the primary cables, and specifically the cross-sectional shapes defined by the insulation structures of those cables, ensures that the capacitance, within the cables and around the conductors, is more uniform. This uniformity results in improvements in the skew characteristics of the cables. As illustrated in FIG. 2, each of the primary cables is twisted, generally along the entire length of the cable.

The outside insulative jacket 18 of cable 10 is formed of a suitable plastic, such as vinyl, for providing electrical insulation of the cable as well as a damage resistant outer structure. Other suitable plastic jackets may be formed of any thermoplastic or fibrous material, e.g. polyethylene, polypropylene, FEP, extruded or wrapped PTFE or braided fiberglass. The first overall shield 14, which is electrically grounded in the cable, comprises a layer of polyester and a layer of metal.

In one embodiment of the invention, the first overall shield 14 is formed by wrapping a tape structure having a polyester layer and a layer of aluminum on one side of the polyester layer around the internal primary cables 12 with sufficient overlap to form a continuous shield of the metal layer. Mylar is a well known PET or polyethylene terephthalate and may be a suitable material for the polyester layer. As discussed further hereinbelow, the tape structure 30 is also utilized for forming the individual shields 24 around the primary cables. A suitable tape includes an aluminum layer, generally in the center of the tape, and formed on one side of the polyester layer. The edges of the tape may be generally free of aluminum. However, to form the first overall shield 14 of cable 10, a polyester-metal tape having a layer of metal which is generally co-extensive with one side of the polyester tape may also be utilized to form shield 14. Preferably, the tape is wrapped so that the metal layer of shield 14 faces outwardly away from the primary cables and toward the second overall shield 16. The second overall shield 16 may be formed of a braided, tinned copper, and generally surrounds the primary cables 12 and shield 14 along their entire lengths. Jacket 18 is then positioned around the second overall shield 16. While preferred embodiments of the first and second overall shields 14 and 16 are disclosed, other shield structures might also be utilized, such as shields formed of helically wrapped copper foil, copper-Mylar tape, or braided, silver plated copper. The second overall shield 16 is preferably electrically grounded by being connected to a ground source (not shown).

Before applying the shields 14, 16 and jacket 18, the primary cables are individually shielded first and then twisted together in accordance with the principles of the present invention. Turning now to the primary cables 12, as shown in FIG. 2, each primary cable 12 includes a pair of generally parallel, spaced conductors 20. The conductors are formed of any suitable conductive metal utilized for such cable structures, such as copper or an alloy containing copper. The conductors may be solid, as shown, or may be made of smaller individual strands. The generally parallel conductors are coupled together and surrounded by a layer of insulation or an insulation structure 22 which maintains the conductors in a precise location with respect to each other within the primary cable. The characteristics of the insulation structure are important, as the structure 22 defines the electrical characteristics of the cable, such as skew properties. In one embodiment, the insulation structure 22 comprises insulation material formed onto the conductors 20 to have generally circular end portions coupled together by center portions with generally flat top and bottom surfaces, as illustrated in FIG. 1. In other embodiments, the cross-sectional shape of the insulation structure 22 could take some other unique and inventive form (See FIGS. 3–7).

Referring to the embodiment of FIG. 1, insulation structure 22 is extruded onto both of the conductors 20 simultaneously, utilizing an extrusion process which is known in the art. Preferably, an expanded PTFE is utilized for layer 22; however, a full density PTFE, PE or other thermoplastic might be utilized. In accordance with one aspect of the invention, the insulation structure 22 is extruded into a unique shape to improve the skew characteristics of the cable. As discussed further hereinbelow, a center support member (not shown in FIGS. 1 and 2) might be utilized in the insulation structure for further support within the cable structure 12. The insulation material would be extruded onto such a structure along with the conductors. Each of the conductors 20 is maintained within the insulation structure of the primary cables. As seen in the Figures, the primary cable will have an elongated, bar-like shape with a specific cross-sectional shape before being twisted together.

FIGS. 1 and 2 illustrate one embodiment of the invention wherein the insulation material extruded over the conductors is continuous and integral over the two conductors to couple the conductors together and lock their relative positions with respect to each other. Specifically, in the embodiment illustrated in FIGS. 1 and 2, the cross-section of the insulation structure 22 is generally oval in form and includes two circular end portions joined by a center portion having generally flat top and bottom surfaces. In accordance with one aspect of the invention, the overall shape of the insulation structure and its electrical characteristics are defined by its cross-sectional shape. Therefore, the invention embodiments disclosed herein are described with respect to the cross-sectional shape of the insulation structure.

Figure 3:
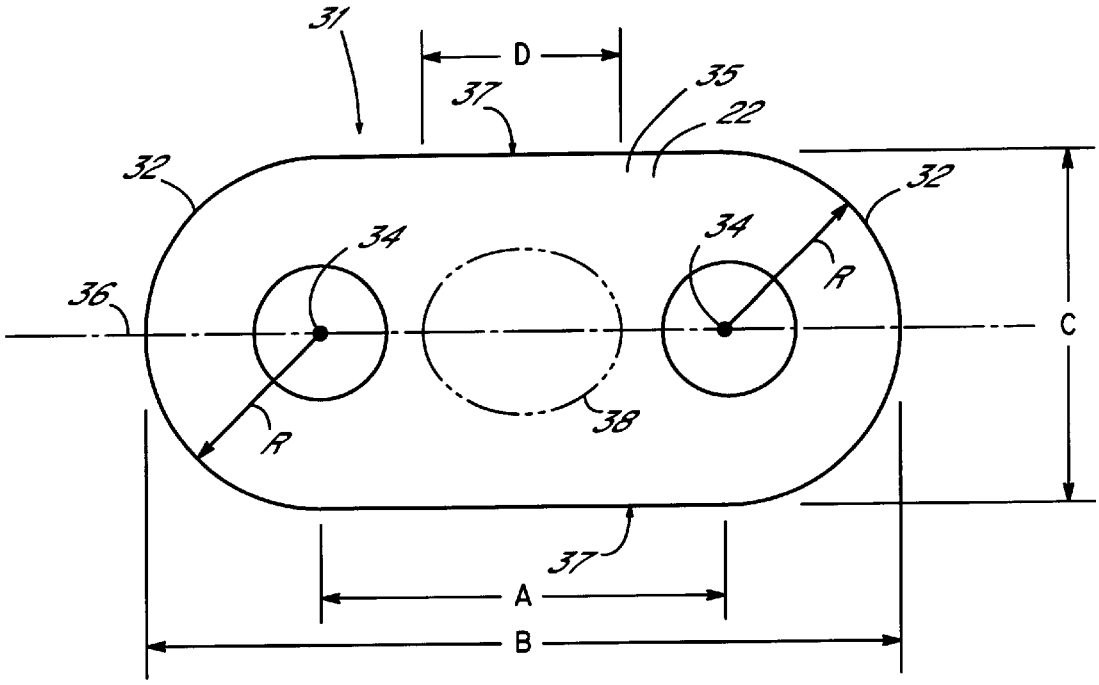
FIG. 3 a cross-sectional view of a primary cable of one embodiment of the inventive cable.

In accordance with one aspect of the present invention, and referring to FIG. 3, the circular end portions 32 of the insulation structure 22 are 10 defined by a radius 'R' as indicated in FIG. 3. In the embodiment of FIG. 3, each of the conductors 34 is positioned at the center of a circle defined by radius 'R' within the insulation structure 22, and is concentric therewith. The circular end portions are actually generally semi-circular. Circular end portions 32 are coupled together by a center portion 35 with top and bottom surfaces 37 which are generally flat. The top and bottom surfaces 37 link the outer surfaces of the circular end portions. That is, surfaces 37 connect semi-circular end portions on the top and bottom of the cable. In accordance with one embodiment of the present invention, the latitudinal or transverse length "A" of the top and bottom of the center portion as shown in FIG. 3, is approximately two times the radius of the circles, or 2R. The dimension "A" is also the distance between the centers of the conductors 34. Therefore, the overall latitudinal length "B" of the insulation structure cross-section is approximately four times the radius of the circles, or 4R. The latitudinal axis of the cable is illustrated by reference numeral 36 in FIG. 3.

When the insulation structure 22 is extruded, a double tube extrusion tip is utilized to guide the conductors in the appropriate locations with the proper spacing, as is conventional in the manufacture of extruded cables. A plastic support member 38 formed of a rigid plastic, such as PTFE, FEP or PE, etc., may be placed in the center of the primary cable 31, and generally aligned with latitudinal axis 36 between the conductors 34. The plastic support member 38 of diameter D is optional and provides the primary cable 31 with greater robustness and rigidity. Referring again to FIG. 3, the cross-sectional height dimension of the embodiment illustrated, indicated by reference letter "C", is approximately 2R or two times the radius dimension of the circular end portions 32 of the insulation structure 22. The center portion 35, defined between the end portions 32, thus has a cross-sectional height dimension "C" reflective of the radius dimension 'R' of the end portions. With the height dimension of the center portion 35 generally the same as a circular diameter defined by the end portions 32 (ie. 2R), the insulation structure cross-section has generally flat top and bottom surfaces 37 as shown in the Figures and discussed herein. In that way, the primary cables may be placed or positioned adjacent to each other such that the flat surfaces 37 of the cables are juxtaposed.

As noted, the dimension "A" defined as a latitudinal or transverse length dimension of the center portion of the cross-section, also defines the distance between the conductors. That distance might be varied as desired for achieving a desirable electrical characteristic in the cable. In the embodiments of the invention shown in FIGS. 3 and 4, the center portion and the end portions of the insulation structure are integrally formed with each other.

Figure 4:
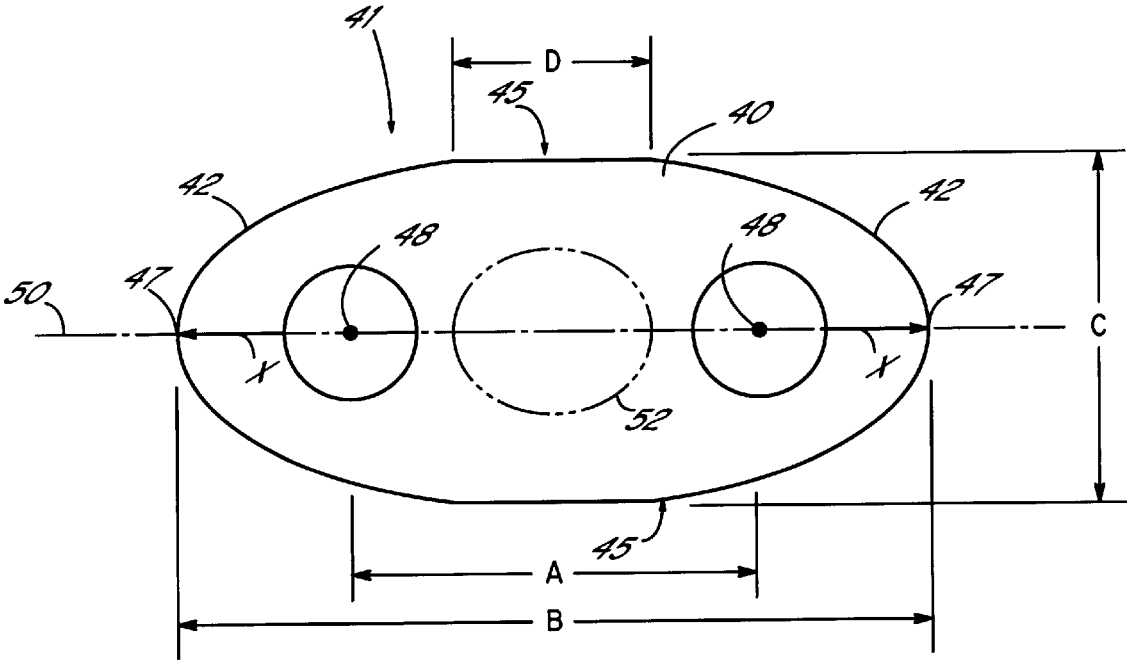
FIG. 4 is a cross-sectional view of a primary cable of another embodiment of the inventive cable.

FIG. 4 illustrates another embodiment of the present invention showing a cross-section for a different insulation structure 40 for the primary cables. Insulation structure 40 includes parabolic end portions 42 which are coupled together by a center portion 44 having generally planar or flat top and bottom surfaces 45. The parabolic end portions 42 are defined by focus points or foci which define the parabolic shape of the end portions 42. The conductors of the primary cable 41 are positioned proximate and preferably at the foci 48 of the parabolic end portions 42 and concentric or coaxial therewith. A radial distance "X" is defined between the outermost point 47 of the parabolic end portions 42 (or bottom point of the parabola) and the foci 48. Referring to FIG. 4, the foci 48 are located on the latitudinal axis 50 of the primary cable 41. The remaining cross-sectional dimensions of the primary cable 41 are based upon the distance "X". For example, the distance between the conductors at foci 48, as indicated by reference letter "A" in FIG. 4, is approximately 2.5X. The overall cross-sectional latitudinal length of the cable, as indicated by reference letter "B" in FIG. 4, is approximately 4.5X. The overall cross-sectional height of the primary cable 41, as indicated by reference letter "C" in FIG. 4, is approximately 3X. A plastic support member 52 might also be utilized within the insulation structure 40 of cable 41 for the purposes as discussed above.

Each of the embodiments of the invention shown in FIGS. 3 and 4 are still in the form of generally bar-shaped cables which may be placed generally flat against each other along their length and twisted along a longitudinal axis, as shown in FIGS. 1 and 2. The flat surfaces 37, 45 of the cables allow them to lie flat against each other in the cable structure as shown in the Figures.

The symmetrical insulation structures 22 and 40, as illustrated in FIGS. 3 and 4 respectively, provide an even charge distribution over the dielectric material making up the insulation structure. In accordance with one aspect of the present invention, the even charge distribution provides a uniform capacitance around each primary conductor, which results in improved signal rising edges and more consistent edge degradation of the signals. The consistency of the rising edges and edge degradation produces lower skew within a cable built utilizing the primary cables disclosed herein. Of course, lower skew results in superior data transfer consistency, without errors, for a given length or conductor gauge. Furthermore, the cables are able to operate at significantly higher frequencies than prior art cables.

The capacitance created on the primaries is the result of charge build up and distribution between a shield wrapped around the primary cable and the dielectric material forming the insulation structures. As discussed further hereinbelow, shielding is wrapped around the primaries and serves as a second conductor of a capacitor, including the conductors of the cable. The charge build up and distribution between the cable conductors and the shield, such as shield 24 as illustrated in FIGS. 1 and 2, is a function of the dielectric constant, or more accurately, the effective dielectric constant of the dielectric insulation material under the shield. The insulation structures, as illustrated in FIGS. 3 and 4, provide for a much more consistent effective dielectric constant along the length of the primary cable, and thus provide for a more even charge distribution on the dielectric. In one embodiment of the invention, the dielectric insulation is an extruded, expanded PTFE which has a very low dielectric constant. Extrusion of the expanded PTFE is done in a conventional manner. A die having a desired cross-sectional shape as illustrated in FIGS. 3 and 4, for example, is utilized to extrude the dielectric. While the cross-sectional dimensions for the dielectric for several embodiments of the invention are discussed above, and based upon defined reference distances, the distance between the conductors and other cross-sectional dimensions of the cables might be optimized. For example, the distance between the foci 48 of the parabolic embodiment of FIG. 4, or the distance between the centers of the circular end portions 32 of the embodiment illustrated in FIG. 3 might be varied to yield a desired impedance for the cable.

Figure 5:
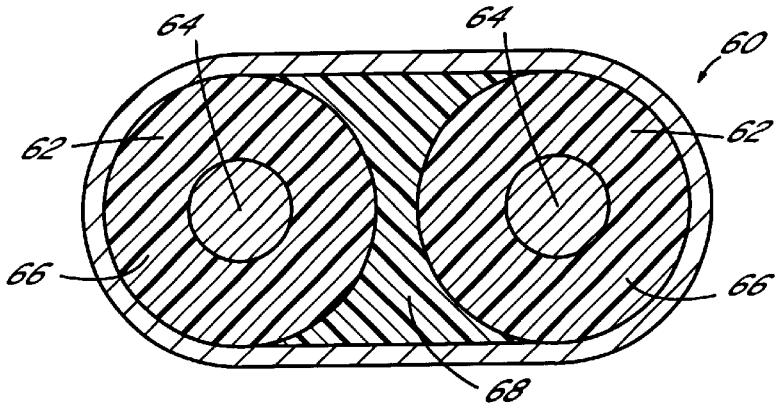
FIG. 5 is a cross-sectional view of a primary cable of another embodiment of the inventive cable.
Figure 6:
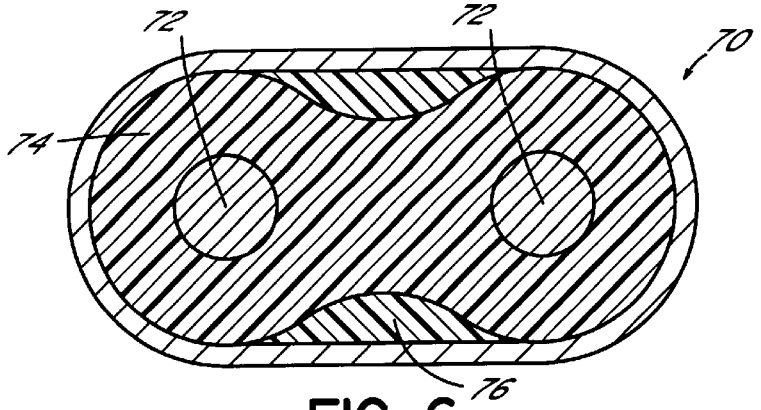
FIG. 6 is a cross-sectional view of a primary cable of another embodiment of the inventive cable.

FIGS. 3 and 4 illustrate several embodiments of the invention. However, the invention might be formed in other ways, utilizing existing primary cable structures. For example, FIGS. 5 and 6 illustrate existing structures which have been modified in accordance with the principles of the present invention. Referring to FIG. 5, a primary cable 60 includes two individual or discrete conductor structures 62, including conductors 64 and an insulative dielectric material 66 therearound. The insulative material 66 has a generally circular cross-section and thus forms the circular end portions of one embodiment of the invention. In accordance with one aspect of the present invention, an insulative dielectric filler material 68 is placed between the conductor structures 62 to form the center portion. Material 68 fuses the conductor structures 62 together into a structure similar to cable 31, for example. Therefore, cable 60 will have circular end portions and a center portion, as shown in FIG. 3. The insulative filler material 68 can be a suitable thermoplastic, such as FEP. Preferably, the filler material has properties which allow it to melt and thus fuse between the individual conductor structures 62. However, it may be desirable to make the insulation filler material 68 the same as the insulation material 66 surrounding the conductor 64. Otherwise, utilizing dissimilar materials between those two insulation structures may compromise the overall cable's effective dielectric constant, and may result in a superior physical structure due to good fusing, but poor electrical performance. Ultimately the filler choice will depend upon the characteristics desired from the cable, such as whether the cable is to be more physically robust, or is to have superior electrical properties.

FIG. 6 illustrates another embodiment utilizing an existing cable structure which has a figure-eight cross-section, such as that shown in the application of Ser. No. 08/991,730. A primary cable structure 70, including conductors 72 surrounded by an insulation structure 74 has a figure-eight cross-section. Insulative filler material 76, fills in the top and bottom sides of the cable 70 in order to further form the desired center portion and yield an insulation structure with a cross-sectional shape similar to that shown in FIG. 3, for example. The material 76 may be similar to material 68 discussed above.

Figure 7:
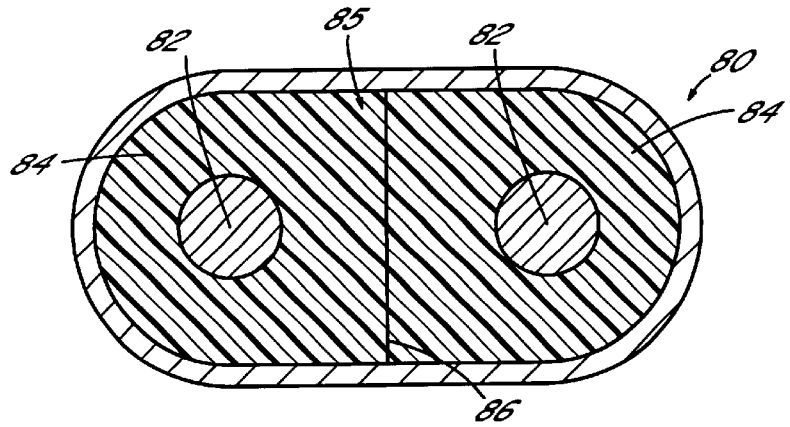
FIG. 7 is a cross-sectional view of a primary cable of another embodiment of the inventive cable.

In still another alternative embodiment of the invention, as illustrated in FIG. 7, each of the individual conductors might be separately insulated and then fused together. For example, in the primary cable structure 80 utilized, each of the conductors 82 is surrounded by an individual or discrete insulation structure 84. That insulation structure, as illustrated in FIG. 7, would have a shaped cross-section which defines circular end portions that are integrally formed with a section 85 of the center portion. The individual conductor structures are brought together and fused together to yield a cable having a cross-sectional shape and dimensions in accordance with the principles of the present invention, such as similar to those embodiments illustrated in FIGS. 3 and 4. The sections of the center portion are fused together along sides 86 to form the complete insulation structure of the cable.

After the primary cables have been individually shielded as discussed further below, the primary cables are positioned generally flat against each other, such as along surfaces 37, 45 and are twisted along their lengths and around a common longitudinal axis, as shown in FIG. 2, to form a compact cable 10 with a double helix structure. The shields 14, 16, and the outer insulation jacket 18 are then applied. The conductors may be whatever gauge is necessary for the cable. However, 22 AWG is one preferable size. As shown in FIG. 2, the twisted primaries 12 form a double helical structure or double helix. The individual cables are twisted such that the cross-sectional latitudinal axes of the primary cables, e.g., axes 36, 50 as shown in FIGS. 3 and 4, are generally parallel with each other along the lengths of the twisted cable, as shown in FIGS. 1 and 2.

In accordance with the principles of the present invention, the primary shields 24 for each primary cable comprise a polyester layer and a metal layer which is formed on each primary cable 12 to create a generally continuous metal shield along the length of the cable 10. The shield is formed with the metal layer facing inwardly toward the insulation layer 22 and the polyester layer facing outwardly toward the first overall shield 14. Therefore, the metal layer is between the polyester layer and the insulation 22. One suitable primary shield layer 24 utilizes a tape 30 having a layer of Mylar in combination with a layer of aluminum, with the aluminum facing inwardly toward the insulation layer 22 of the primary cable 12.

Referring to FIG. 2, tape 30 is wrapped around each bar-shaped primary cable 12 in a series of turns. The adjacent turns of tape 30 are helically overlapped such that the aluminum layers (not shown) of each turn, overlap along the length of the primary cable 12 such that the aluminum layer of one turn overlaps with the aluminum layer of the adjacent turn. In that way, an overlapped section of the aluminum layers is formed to create a metal overlap section or shield. Greater detail of such a construction is shown in Ser. No. 08/991,730. Accordingly, the metal shield, and preferably aluminum shield 24, is formed along the length of the primary cable 12 as a continuous shield along the cable 12. The metal layer of tape 30 faces inwardly toward the insulation layer 22 of each primary cable 12. In that way, the polyester layer faces outwardly and thus forms an outer continuous polyester layer along the outside of each primary cable. The outer polyester layer electrically insulates the metal conductive layer from the first overall shield 14. Thus, as mentioned above, the primary shield layer 24 is electrically floating with respect to shield 14.

One suitable aluminum-Mylar tape product is available from Neptco of Pawtucket, R.I. The tape comes in various widths, whereas one suitable width for the tape of the disclosed embodiment is relatively narrow and is approximately 0.5 inches wide. The tape available from Neptco has a Mylar layer which is 0.7 mil thick, coupled with an aluminum layer which is 0.8 mil thick. Therefore, the overall tape, when wrapped around each primary cable forms a shield layer 24 having a thickness of approximately 2–3 mils. A wrap structure of approximately twenty-five turns per foot at an angle of wrap of approximately 50° has been found suitable for forming the shield layer 24 of the invention. The inventor has found that wrapping the primaries with the relatively narrow tape provides better performance in the inventive cable than wider tape. The narrow tape provides a primary cable that is easier to twist together with another primary cable, thus minimizing mechanical distortion. This tends to make the electrical performance more consistent from foot to foot. Wider tape wraps faster, but provides a product with a less consistent performance.

Although one type of wrapping scenario is disclosed, other types may be utilized. For example, different helical wrapping angles between 1°–89° might be utilized. Furthermore, a longitudinal wrap, also known as a cigarette fold wrap, might be utilized for shielding the individual cables.

Turning to FIG. 2, the primary cables 12 are each individually wrapped with aluminum-Mylar tape 30 to first form shield layer 24. The primaries are then placed side-by-side and twisted together to form a double helix structure which forms the round cable. That is, the primary cables are twisted after the shield layers 24 have been formed thereon. FIG. 2 illustrates the double helix where the two primary cables 12 lie flat against each other and are twisted together to be intertwined along their lengths. The two pairs are twisted together into the double helix structure about a common center longitudinal axis 50. It has been discovered, as an aspect of the invention, that by wrapping each primary cable first with the aluminum-Mylar tape to form shield 24 and then subsequently twisting the primary, either in single pass or separate passes through the process, the expanded PTFE dielectric insulation layer 22 is locked more positively within the twisted primary cable structures to yield a more consistent effective dielectric constant along the long axis of cable 12. The primary cables 12 are preferably twisted in the same direction that the tape 30 was wrapped when forming shield layer 24. In that way, the shield 24 effectively tightens further around the primary cables and further locks the insulation layer 22 of the primary cables into position within cable structure 10. The cables formed in accordance with the principles of the present invention provide reduced differential signal skew, reduced signal attenuation, and further maintain the integrity of the transmitted signal by maximizing the potential output eyepattern of the transmitted signal over greater cable lengths. Furthermore, the inventive cable provides more even charge distribution on the insulative dielectric of the primary cables and thereby improves the rising edge characteristics of the signal on the cable with more consistent edge depredation of the signal. This further improves the skew characteristics of the inventive cable structure.

In order to reduce signal skew, it is important to maintain the dielectric constant of the insulation layer 22 generally consistent along its length. A variation in the dielectric constant as seen by either of the conductors 20 with respect to the other conductor will produce a time delay difference in the propagation of the differential transmission signal along the primary cable. It has been discovered that the double helical structure that is formed by the unique twisting of the primary cables together and the twisting of the unique shields 24 surrounding the primary cables 12 of the present invention, provides a greater consistency to the effective dielectric constant along the length of each primary cable, thus reducing signal skew. It has further been determined that the unique cross-sectional shapes of the insulation in the primary cables provides more even charge distribution on the dielectric insulative material, thereby making the capacitance around each conductor more consistent and improving the signal rising edges and improving the consistency of the rising edge degradation. As noted, a suitable material for the extruded insulation layer 22 is expanded PTFE. While a preferred embodiment of the invention utilizes the expanded PTFE, other suitable insulation materials might be formed of cellular polyethylene or FEP.

As shown, each primary cable 12 includes its own shield or shield layer 24 to surround the primary cable. The shield layer 24 extends along the entire length of the primary cable 12 and is operable for electrically isolating each primary cable from the other primary cable within the overall structure 10.

The high-speed data transmission cable 10 formed in accordance with the principles of the present invention as disclosed herein provides a substantial improvement in the differential signal skew and minimizes the signal attenuation at the driven frequencies of the cable. Furthermore, the improvement in the differential signal skew and the attenuation characteristics of cable 10 allows the cable to be utilized at greater lengths than is typical for prior art differential signal cables. Still further, the individual shields 24 around the primaries substantially reduce the cross-talk between the primary cables, and thus isolates each primary cable more effectively from the other primary cable and also from interference coming from outside of the cable structure 10. High frequency electromagnetic fields generated by each primary cable are enclosed to thus reduce the interference between the primary cables 12. More specifically, the currents induced in the shield by the high frequency EM fields are enclosed within the primary cables 12. It has been determined that the invention provides a reduction of interference even though the primary shields 24 are not terminated to ground for electromagnetic current dissipation. The primary shields do not make electrical contact with any of the overall shields, and thus they are generally floating, in an electrical sense. It has been discovered that when the primary shield is grounded by means of a drain wire within each primary cable, performance tends to be unaffected.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A high speed data transmission cable comprising:

a pair of primary cables positioned adjacent to each other along their lengths;

each primary cable including a pair of generally parallel conductors which are coupled together by an insulation structure;

the insulation structure having a cross-section including circular end portions wherein each end portion is defined by a center point and a radius dimension, the conductors positioned proximate the center points of the circular end portions;

the circular end portions being coupled together by a center portion, the center portion having cross-sectional height dimension reflective of the radius dimension of the end portions such that the insulation structure cross-section has generally flat top and bottom surfaces;

a shield layer surrounding each primary cable along its length to isolate the primary cables from each other;

the primary cables and corresponding shield layers being twisted together around a center axis located between the primary cables and forming a double helical structure;

thereby providing improved transmission characteristics in the high speed data transmission cable.

2. The transmission cable of claim 1 wherein the conductors are spaced from each other a distance approximately two times the radius dimension of the circular end portions.

3. The transmission cable of claim 1 wherein the cross-sectional height dimension of the center portion is approximately two times the radius dimension of the circular end portions.

4. The transmission cable of claim 1 wherein the shield includes a polyester layer.

5. The transmission cable of claim 1 wherein the shield includes a metal layer.

6. The transmission cable of claim 1 wherein a latitudinal length dimension of the insulation structure cross-section is approximately four times the radius dimension of the circular portions.

7. The transmission cable of claim 1 further comprising a first overall shield layer surrounding the primary cables and comprising a polyester layer and a metal layer adjacent at least one side of the polyester layer.

8. The transmission cable of claim 7 further comprising a second overall shield layer surrounding said primary cables.

9. The transmission cable of claim 1 further comprising a support member positioned within said insulation structure and generally between the conductors.

10. The transmission cable of claim 1 wherein said insulation structure surrounding the primary conductors includes PTFE.

11. The transmission cable of claim 1 wherein said center portion and the circular end portions of the insulation structure are integrally formed.

12. The transmission cable of claim 1 wherein said circular end portions are formed individually, the center portion being formed between the individual circular end portions and fused thereto to form the insulation structure.

13. The transmission cable of claim 1 wherein said circular end portions are coupled together to have a generally figure eight cross-section, the center portion being formed with the figure eight cross section and fused thereto to form the insulation structure.

14. The transmission cable of claim 1 wherein said circular end portions are integrally formed with a section of the center portion, the sections of the center portion being fused together to form the insulation structure.

15. A high speed data transmission cable comprising:

a pair of primary cables positioned adjacent to each other along their lengths;

each primary cable including a pair of generally parallel conductors coupled together by an insulation structure;

the insulation structure having a cross-section including parabolic end portions wherein each end portion is defined by a focus point, the conductors positioned proximate the focus points of the parabolic end portions;

a shield layer surrounding each primary cable along its length to isolate the primary cables from each other;

the primary cables and corresponding shield layers being twisted together around a center axis located between the primary cables and forming a double helical structure;

thereby providing improved transmission characteristics in the high speed data transmission cable.

16. The transmission cable of claim 15 further comprising a center portion positioned between the parabolic end portions to couple the end portions together in the insulation structure.

17. The transmission cable of claim 16 wherein a focus point is positioned a defined distance from a bottom point of the parabolic end portion, the cross-sectional height of the center portion being approximately three times the defined distance dimension of the end portions.

18. The transmission cable of claim 16 wherein said center portion and the parabolic end portions of the insulation structure are integrally formed.

19. The transmission cable of claim 16 wherein said parabolic end portions are integrally formed with a section of the center portion, the sections of the center portions being fused together to form the insulation structure.

20. The transmission cable of claim 15 wherein a focus point is positioned a defined distance from a bottom point of the parabolic end portion, the conductors being spaced from each other a distance which is approximately two and one-half times the defined distance of the end portions.

21. The transmission cable of claim 15 wherein the shield includes a polyester layer.

22. The transmission cable of claim 15 wherein the shield includes a metal layer.

23. The transmission cable of claim 15 wherein a focus point is positioned a defined distance from a bottom point of the parabolic end portion, the latitudinal length of the insulation structure cross-section being approximately four and one-half times the defined distance of the end portions.

24. The transmission cable of claim 15 further comprising a first overall shield layer surrounding the primary cables and comprising a polyester layer and a metal layer adjacent at least one side of the polyester layer.

25. The transmission cable of claim 24 further comprising a second overall shield layer surrounding said primary cables.

26. The transmission cable of claim 15 further comprising a support member positioned within said insulation structure and generally between the conductors.

27. The transmission cable of claim 15 wherein said insulation structure surrounding the primary conductors includes PTFE.

* * * * *

UNITED STATES PATENT AND TRADEMARK OFFICE

CERTIFICATE OF CORRECTION

PATENT NO. : 6,403,887 B1 
DATED : June 11, 2002
INVENTOR(S) : Matthew T. Kebabjian and Jerry J. Kulaga It is certified that error appears in the above-identified patent and that said Letters Patent is hereby corrected as shown below:

Column 1,
Line 57, reads “a balanced-signal” and should read -- a balanced signal --.

Column 2,
Line 41, reads “by the 20 physical structure of the” and should read -- by the physical structure of the --.
Line 64, should not begin a new paragraph.

Column 3,
Line 17, should not begin a new paragraph.

Column 7,
Line 13, reads “insulation structure 22 are 10 defined by” and should read -- insulation structure 22 are defined by --.

Column 11,
Line 31, reads “eyepattern” and should read -- eye-pattern --.

Signed and Sealed this

Eleventh Day of February, 2003

JAMES E. ROGAN
*Director of the United States Patent and Trademark Office*